United States Patent [19]

Zipper

[11] 4,227,618

[45] Oct. 14, 1980

[54] EXPANSION SECTION FOR TAMPER-INDICATING RING OF SQUEEZE-OFF CLOSURE

[75] Inventor: Donald H. Zipper, Western Springs, Ill.

[73] Assignee: The Continental Group, Inc., New York, N.Y.

[21] Appl. No.: 50,933

[22] Filed: Jun. 21, 1979

[51] Int. Cl.[2] ..... B65D 41/46

[52] U.S. Cl. ..... 215/253; 215/274; 292/256.6; 215/262; 215/321

[58] Field of Search ..... 215/246, 262, 321, 345, 215/346, 274, 253, 254; 220/270, 266, 281, 319; 292/256.6, 256.63

[56] References Cited

U.S. PATENT DOCUMENTS

| | | | |
|---|---|---|---|
| 2,817,453 | 12/1957 | Stover | 215/352 X |
| 3,057,503 | 10/1962 | Salzmann | 215/253 |
| 3,489,308 | 1/1970 | Podesta | 215/346 X |
| 3,603,472 | 9/1971 | Lecinski | 215/346 X |
| 3,746,199 | 7/1973 | Hart | 215/346 X |
| 3,820,678 | 6/1974 | Zipper | 215/253 |
| 3,951,292 | 4/1976 | Amberg | 215/246 X |

*Primary Examiner*—Donald F. Norton
*Attorney, Agent, or Firm*—Charles E. Brown

[57] ABSTRACT

This disclosure relates to a tamper-indicating band which is utilized in conjunction with a closure for normally preventing the distortion of the closure as would be required to effect the removal of the closure. A tamper-indicating ring includes a continuous band which must be ruptured in order to remove the tamper-indicating ring. When the processing of the container assembly requires the introduction of heat, the tamper-indicating ring is heated and the band expands and then shrinks. Difficulties encountered with this first expansion and later shrinkage have been solved by forming the band in a plurality of sections connected together by expansion segments.

12 Claims, 4 Drawing Figures

FIG. 1
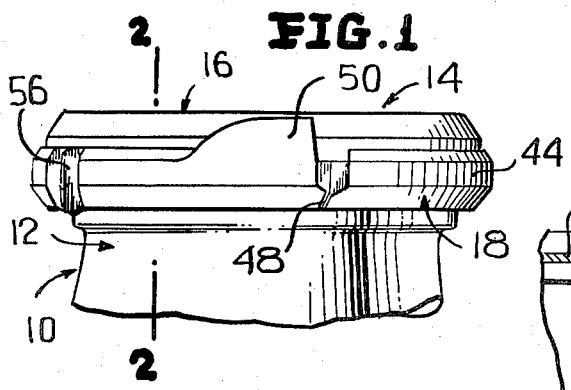
FIG. 2
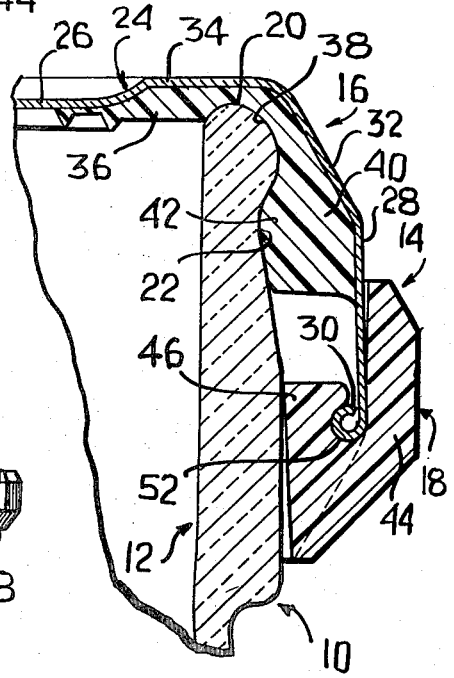
FIG. 3
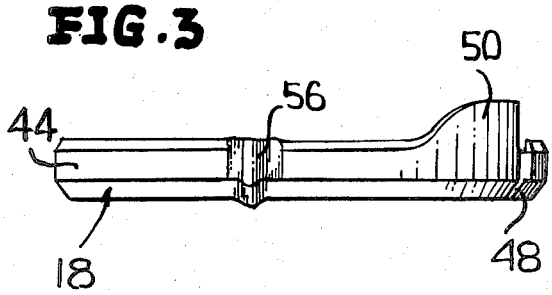
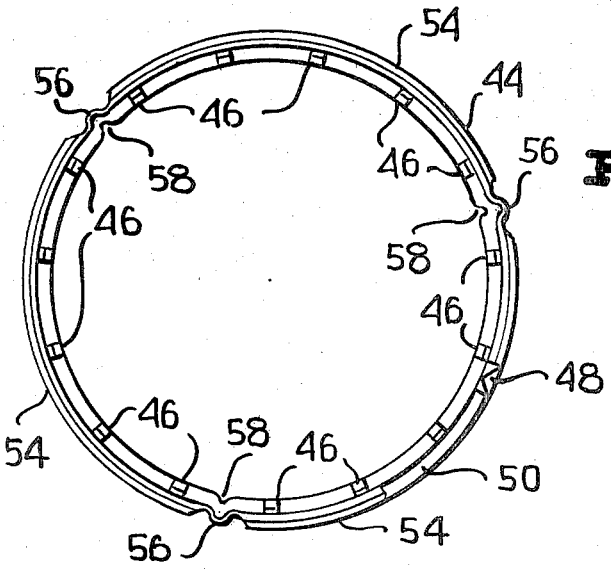
FIG. 4

EXPANSION SECTION FOR TAMPER-INDICATING RING OF SQUEEZE-OFF CLOSURE

This invention relates in general to new and useful improvements in closures for containers, and more specifically to a container closure which is provided with a tamper-indicating ring.

There has been devised by another a closure which is particularly adapted for use in combination with a container having a product vacuum packaged therein wherein the closure may be released by applying pressure thereon at diametrically opposite points. It will be apparent that such closures may be accidentally or intentionally removed by others than the final purchaser. In order to prevent this and maintain the integrity of the package, there has been provided a tamper-indicating ring which is disposed between the skirt of the closure and the external finish of the container so as to prevent the deformation of the closure even when required pressure is applied. These tamper-indicating rings are formed of a plastic material and in the event the container, closure assembly and product are subject to heating as in the retort processing of a product, the plastic maerial of the tamper-indicating ring expands and frequently becomes separated from the closure in an undesired manner.

In accordance with this invention, it is proposed to provide the tamper-indicating ring with expansion means for accommodating the expansion of the plastic material when heated so as to prevent the premature dislodging of the tamper indicating ring from the closure.

A further difficulty encountered with the prior tamper-indicating ring is that after being heated, on cooling, the ring will shrink below its original circumference and apply an undesired pressure on a weakened section thereof so that breakage of the tamper-indicating ring occurs prematurely during the processing of the product and thus gives a false indication that the container assembly has been tampered with.

It has been found that the aforementioned deficiencies could be solved by injection molding the tamper-indicating ring to a controlled dimension and then annealing it in a heated environment to shrink it back to the proper size for cooperation with the closure. The plastic material of the ring would then be heat stable for further processing exposure. However, this method of preparing the tamper-indicating ring is not considered to be efficient in that an additional operation would be required in its manufacture with this additional operation requiring high energy use.

Accordingly, the problem has been solved by incorporating in a band portion of the ring a segment or segments which are capable of expanding as needed to add circumferential dimension and also to compensate for any final shrinkage in the tamper-indicating ring.

With the above and other objects in view that will hereinafter appear, the nature of the invention will be more clearly understood by reference to the following detailed description, the appended claims, and the several views illustrated in the accompanying drawings.

In the Drawings:

FIG. 1 is a side elevation view of the upper portion of a container assembly including a container and a closure assembly including a closure and a tamper-indicating ring in accordance with this invention.

FIG. 2 is an enlarged fragmentary vertical sectional view taken generally along the line 2—2 of FIG. 1, and shows specifically the details of the container assembly.

FIG. 3 is a side elevational view of the tamper-indicating ring per se, rotated from its position of FIG. 1.

FIG. 4 is a plan view of the tamper-indicating ring of FIG. 3.

Referring now to the drawings in detail, it will be seen that there is illustrated in FIG. 1 a container assembly generally identified by the numeral 10. The container assembly includes a container 12 which is illustrated as being in the form of a glass tumbler, but which may be of varied configuration. The open end of the container 12 is closed by a closure assembly generally identified by the numeral 14. The closure assembly 14 includes a closure 16 and a tamper-indicating ring 18.

Referring now to FIG. 2, it will be seen that the container 12 has an upper finish which includes a terminal sealing surface 20 and an external undercut finish 22.

It will also be seen in FIG. 2 that the closure 16 includes a cap-like body 24 which is preferably formed of thin resilient and flexible metal. The body 24 includes an end panel 26 and a depending skirt 28 with the skirt 28 terminating in a curl 30 and having an upper portion 32 which tapers radially inwardly and terminates in an upwardly offset peripheral portion 34 of the end panel 26.

The closure 16 also includes a sealing ring 36 which is formed of a suitable gasket material and which is molded so as to define a seat 38 for the sealing surface 20. The sealing ring 36 further includes an annular portion 40 which extends axially within the skirt 28 and which includes lug means 42 interlockingly engageable with the undercut finish 22.

It will be readily apparent that the sealing ring 36 is molded in situ within the cap-like body 24 and is basically seated within a channel defined at the peripheral corner between the end panel 26 and the skirt 28. The lug means 42 may either be continuous or in the form of separate upstanding ribs or lugs which are circumferentially spaced, depending upon the desired resealing holding power of the lug means 42.

When the product is vacuum packaged within the container assembly 10, the closure 16 is held in place primarily by the pressure differential between the external atmosphere and the lower pressure internal condition. However, if the seal between the sealing surface 20 and the sealing ring 36 can be interrupted over a small area, the vacuum can be relieved and thereafter the closure 16 may be readily removed.

In accordance with the concept of the closure 16, the skirt 28 may be squeezed at diametrically opposite points, with the result that at generally right angles to the line of pressure application the resilient and flexible body 24 will flex upwardly, moving the sealing ring 36 out of engagement with the sealing surface 20, breaking the seal and thus relieving the vacuum. The difficulty is that if such a product were placed in an exposed position on a shelf as is required for selling, the container could be prematurely opened by one squeezing on the skirt of the closure. To prevent this, there has been provided the tamper-indicating ring 18.

The tamper-indicating ring 18 basically includes a continuous band 44 which has extending radially inwardly from the inner surface thereof a plurality of circumferentially spaced lugs or ribs 46. The purpose of the lugs 46 is to prevent the radially inward deformation of the skirt 28.

In order to facilitate removal of the tamper-indicating ring 18, the band 44 is provided with a transverse line of weakness 48 along which the band 44 may be separated. Immediately adjacent the line of weakness 48, the band 44 carries an upstanding lever 50 which may be readily moved radially outwardly to effect rupture of the band 44 along the line of weakness.

One of the features of the closure assembly 14 is that the closure 16 and the tamper-indicating ring 18 are suppliable as a single unit which can be merely pressed into place to effect the closing of the container 12. This requires an interlocking between the tamper-indicating ring and the closure. The interlocking is by way of a socket 52 formed between each lug 46 and an adjacent portion of the band 44 and receiving in interlocking relation the curl 30.

As previously stated, when the tamper-indicating ring 18 is heated in the processing of a product or if heat is otherwise involved such as the closure being vapor sealed in a steam atmosphere, the tamper-indicating ring 18 becomes heated with the result that the band 44 first elongates and then shrinks. If the band 44 is continuous and has no expansion means, in many instances upon expanding it will move downwardly and at least partially disengage from the curl 30 so that when it shrinks back to its original condition or smaller it will no longer be properly associated with the skirt 28 of the closure. Further, as described above, when the band 18 cools it will frequently shrink to a diameter smaller than the originally molded diameter, with the result that the band will be placed in tension to the extent that rupture along the line of weakness 48 will occur.

This invention has to do with the modification of the tamper-indicating ring 18, and most particularly with respect to the formation of the band 44.

As is best shown in FIGS. 3 and 4, the band 44 is formed as a plurality of segments 54 which are connected together by expansion segments 56. Each expansion segment 56 includes a reversely folded portion 58 which not only permits a certain degree of collapsing under circumferential pressures as occurs when the band 44 is heated, but also permits an elongation of the band when the band shrinks following the heating thereof. Thus, the expansion segments 56 serve both to absorb the additional material which form the expansion of the band and also provides the necessary additional material when the band shrinks below its original diameter.

The expansion segments 56 in no way detract from the function of the tamper-indicating ring and are preferably disposed between circumferentially adjacent lugs 46 as is clearly illustrated in FIG. 4.

It is to be understood that when it is desired to open the container, the band 44 is ruptured along the line of weakness 48 and then the tamper-indicating ring 18 is progressively peeled downwardly and radially outwardly from the skirt 28. Once the tamper-indicating ring 18 has been removed, the skirt 28 may be radially inwardly deformed so as to effect breaking of the seal between the closure and the container as described hereinbefore.

Although only a preferred embodiment of the stress relieving feature has been specifically illustrated and described herein, it is to be understood that minor variations may be made therein without departing from the spirit and scope of the invention as defined by the appended claims.

I claim:

1. A closure assembly comprising a closure member including a body having an end panel and a depending skirt and a sealing ring within said body for engaging a container sealing surface, and a tamper-indicating ring carried by said skirt and having a portion disposed radially inwardly of said skirt for normally preventing radial inward deflection of said skirt, said tamper-indicating ring being characterized in that it includes expansion means for accommodating expansion of said tamper-indicating ring during heating thereof.

2. The closure assembly of claim 1 wherein said tamper-indicating ring includes a continuous band having at least one line of weakening therein for effecting rupture of said band for freeing said tamper-indicating ring for removal, and said expansion means being formed in said band.

3. The closure assembly of claim 1 wherein said skirt terminates in a curl and said tamper indicating band has a socket receiving said curl for maintaining said closure assembly as a unit for application, and during expansion of said band, said curl acting as a track.

4. The closure assembly of claim 1 wherein said closure assembly is carried by a container having a sealing finish engaged by said sealing ring.

5. The closure assembly of claim 4 wherein there is a vacuum within said container with said vacuum acting at least in part as means for retaining said closure on said container.

6. The closure assembly of claim 1 wherein said tamper-indicating ring includes a band, said band including band portions joined by expansion portions.

7. The closure assembly of claim 6 wherein said expansion portions include reversely folded parts.

8. A tamper indicating ring for use with a closure having a depending skirt intended to be spaced from an adjacent container wall, said tamper-indicating ring including a continuous band having at least one line of weakening for effecting rupture of said band, said band having radially inwardly projecting lug means for positioning between a container and a closure skirt, and means for interlocking said ring to a closure skirt, said tamper-indicating ring being characterized in that it includes expansion means for accommodating expansion of said tamper-indicating ring during heating thereof.

9. The tamper-indicating ring of claim 8 wherein said lug means are in the form of a plurality of radial lugs disposed in circumferentially spaced relation.

10. The tamper-indicating ring of claim 8 wherein said lug means are in the form of a plurality of radial lugs disposed in circumferentially spaced relation, and socket means formed between said lugs and said band for interlockingly receiving a free edge of a closure skirt.

11. The tamper-indicating ring of claim 8 wherein said band includes band portions joined by expansion portions.

12. The tamper-indicating ring of claim 11 wherein said expansion portions include reversely folded parts.

* * * * *